United States Patent [19]

Baer et al.

[11] 3,970,036

[45] July 20, 1976

[54] TONER CONCENTRATION DETECTOR FOR DRY POWDER MAGNETIC BRUSH TONING SYSTEM

[75] Inventors: James A. Baer, Menlo Park; Charles B. Clark, Los Altos; Louis F. Schaefer, Palo Alto, all of Calif.

[73] Assignee: Savin Business Machines Corporation, Valhalla, N.Y.

[22] Filed: July 17, 1974

[21] Appl. No.: 489,389

[52] U.S. Cl. ..... 118/7; 222/56; 324/34 R

[51] Int. Cl.[2] ..... G03G 15/08

[58] Field of Search ..... 118/7, 637, DIG. 24, 118/9; 117/17.5; 324/34 R, 41; 222/55–57; 209/246

[56] References Cited

UNITED STATES PATENTS

| | | | |
|---|---|---|---|
| 1,755,103 | 4/1930 | Davis | 222/55 |
| 2,393,717 | 1/1946 | Speaker | 324/340 SC |
| 2,442,805 | 6/1948 | Gilson | 324/340 SC |
| 3,233,781 | 2/1966 | Grubbs | 222/57 |
| 3,303,817 | 2/1967 | Cranch et al. | 117/17.5 X |
| 3,572,551 | 3/1971 | Gillespie et al. | 222/56 |
| 3,698,926 | 10/1972 | Furuichi | 118/637 X |
| 3,707,947 | 1/1973 | Reichart, Jr. | 118/637 |
| 3,828,730 | 8/1974 | Yamashita et al. | 118/637 |

OTHER PUBLICATIONS

*IBM Technical Disclosure Bulletin*, "Sensor Circuit Utilizing Variable Inductance Input," Ogren, vol. 14, No. 4, (Sept. 1971), p. 1225.

*Primary Examiner*—Morris Kaplan
*Attorney, Agent, or Firm*—Shenier & O'Connor

[57] ABSTRACT

A toner concentration detecting and toner replenishing system for use in an electrostatic copier having a magnetic brush which carries dry developer comprising a mixture of ferromagnetic carrier particles and toner particles into contact with the surface of a photoconductor upon which a latent electrostatic image has been formed, in which system a quantity of developer is removed from the magnetic brush after development of the image and the brush leaves the surface. The removed developer is directed into a dielectric tube having a restricted outlet which inhibits unstable flow through the tube so that developer in the tube determines the inductance of a coil surrounding the tube. The coil is one element of the tuned circuit of a sensing oscillator, the output frequency of which is compared with that of a tunable reference oscillator to provide a frequency difference signal which is a measure of the relative proportion of toner to carrier in the developer. This frequency difference signal is employed to actuate a toner replenishing system to feed toner from the supply to the developer supply as required to maintain the toner concentration substantially constant.

17 Claims, 7 Drawing Figures

14
30
36
68
74
76
78
80
82
84
86
88
90
92
94
96
98
100
102
104
106
108
110
112
114
116
118
120
122
124
a
b

TONER CONCENTRATION DETECTOR FOR DRY POWDER MAGNETIC BRUSH TONING SYSTEM

BACKGROUND OF THE INVENTION

There are known in the prior art electrostatic copying machines in which a latent electrostatic image produced on the surface of the photoconductor is developed by subjecting the image to the action of a developer made up of a mixture of ferromagnetic particles and of fusible toner particles. In general there are two systems for applying the developer to the surface of the photoconductor carrying the latent image. In the first of these arrangements a conveyor is employed to carry developer from a supply to a location at which it is dumped onto the photoconductive surface so as to cascade over the image. As the developer moves over the image, the triboelectric toner particles adhere to those areas of the image which have retained charge after exposure. The cascaded material leaving the photoconductive surface falls under the influence of gravity back into the supply of developer.

In the other widely used dry developer applicator system, an arrangement of permanent magnets disposed within a hollow rotating cylinder of magnetic material causes ferromagnetic particles of developer in which the cylinder is partially immersed to be attracted to the surface of the rotating cylinder in such a way as to form what is known as a "magnetic brush." As the brush cylinders rotates, the brush engages the surface of the drum or the like carrying the photoconductor, and toner particles in the developer mixture on the brush adhere to the drum surface in areas thereof which have retained charge following exposure to an image of the original to be copied. The arrangement of the permanent magnets is such that developer is permitted to fall from the surface of the magnetic brush drum after it leaves the surface of the photoconductor.

As images are developed in an electrostatic copier, toner from the developer mixture is depleted, while the ferromagnetic carrier particle content of the developer remains the same. In order that faithful copies be made with the desired degree of consistency, it is necessary that the proportion of toner to carrier, or the toner concentration, remain substantially constant. In attempts to achieve relatively constant toner concentration in machines of the prior art, a number of approaches have been taken. The first and most elementary of these is periodic actuation of a toner replenisher supply to add the toner constituent to the developer mixture periodically. This arrangement has not proven satisfactory to the reason that it does not take into account variations in the proportion of dark to light areas in documents or the like being copied. That is to say, over one period of time documents having large black areas requiring relatively great amounts of toner may be copied, while during another period of time documents having great white areas requiring very little toner may be copied. Where toner is periodically added to the developer mix, there may be either too much toner in the mix or too little at any one time, resulting in unsatisfactory operation.

Various proposals have been advanced for overcoming the problem outlined above resulting from periodic addition of toner to the developer supply. All of these attempts involve monitoring the developer to obtain a measure of the concentration of toner therein.

Shelffo et al U.S. Pat. No. 3,527,651 shows an arrangement for use in a developer applicator system of the magnetic brush type, in which an electrode is positioned in contact with the bristles of the brush in an attempt to measure changes in the electrical resistance of the developer. The difficulties inherent in such a system will readily be apparent. There is, first, the uncertainty of contact with the bristles of the brush and the criticality of the position of the electrode with relation to the brush cylinder. Further, owing to the wide variation in size of the carrier particles, the brush structure is irregular, adding to the uncertainty of the measurement.

Gawron U.S. Pat. No. 3,707,134 discloses an arrangement in which an attempt is made to determine toner concentration by positioning an iron core coil adjacent to the magnetic brush cylinder with the coil axis generally perpendicular to the cylinder axis. Permanent magnets are employed to attract the carrier particles on the cylinder toward the end of the coil. Changes in the inductance of the coil in response to changes in toner concentration on the portion of the developer adjacent to the coil are used to add toner to the developer mix. This arrangement likewise is relatively uncertain, since only a very small amount of developer is being monitored at any instant. In addition, it is relatively critical, since, as the patentee points out, the magnets employed, while they must be of sufficient strength to attract particles toward the end of the coil, must not be sufficiently strong to cause the particles to move onto the end of the coil or a false indication will be obtained.

Furuichi U.S. Pat. No. 3,698,926 discloses a developer monitoring arrangement for use with a developing system of the cascade type. In the arrangement shown in this patent, developer material falling off the photoconductive surface is collected in a funnel of nonmagnetic material having a cylindrical outlet tube surrounded by a coil. While the patentee suggests that the bottom opening of the funnel be made relatively narrow, he discloses no means for controlling the flow of developer from the bottom opening of the funnel through the cylindrical tube carrying the coil. We have found that, while passing developer material through a coil represents a good approach to the problem of monitoring toner concentration, the results achieved, however, are greatly affected by the manner in which the material flows through the coil. More particularly, we have discovered that if the material is permitted to pass freely through the funnel discharge tube as in Furuichi, the results produced are unreliable.

We have invented a toner concentration detector and replenisher which is especially adapted for use with a magnetic brush developing system. Our detector produces consistently reliable results. It is certain in operation. It insures that the toner concentration remains substantially constant. Our detector accurately measures relatively small changes in toner concentration.

SUMMARY OF THE INVENTION

One object of our invention is to provide a toner concentration detector and toner replenisher system which is especially adapted for use with a magnetic brush developing system.

Another object of our invention is to provide a toner concentration detector and toner replenishing system which insures that the toner concentration in the developer mix remains substantially constant on successive operations of the machine.

A further object of our invention is to provide a toner concentration detector and toner replenisher system which produces consistently reliable results.

A still further object of our invention is to provide a toner concentration detector which accurately measures relatively small changes in toner concentration.

Still another object of our invention is to provide a toner concentration detector and toner replenishing system which is certain in operation.

Other and further objects of our invention will appear from the following description.

In general our invention contemplates the provision of a toner concentration detecting and toner replenishing system for an electrostatic copier of the type which employs a magnetic brush to carry dry developer comprising a mixture of ferromagnetic carrier particles and toner particles into contact with the surface of a photoconductor carrying a latent electrostatic image. We remove a quantity of the developer after development of a latent image from the magnetic brush after the brush leaves the developed image on the photoconductive surface. We direct the removed developer into a conduit or duct of dielectric material having a predetermined cross-sectional area and having an outlet which is restricted with respect to said area to provide a predetermined relationship which inhibits unstable flow of the removed developer through the duct. A coil surrounding the duct comprises an element of a sensing oscillator, the frequency of which is compared with that of a tunable reference oscillator to provide a frequency difference signal which is a measure of the relative proportion of toner to carrier in the developer. This toner concentration signal is employed to actuate a toner replenishing system to feed toner from a supply of toner to the developer supply.

DESCRIPTION OF THE PREFERRED EMBODIMENT

Figures 1, 2:
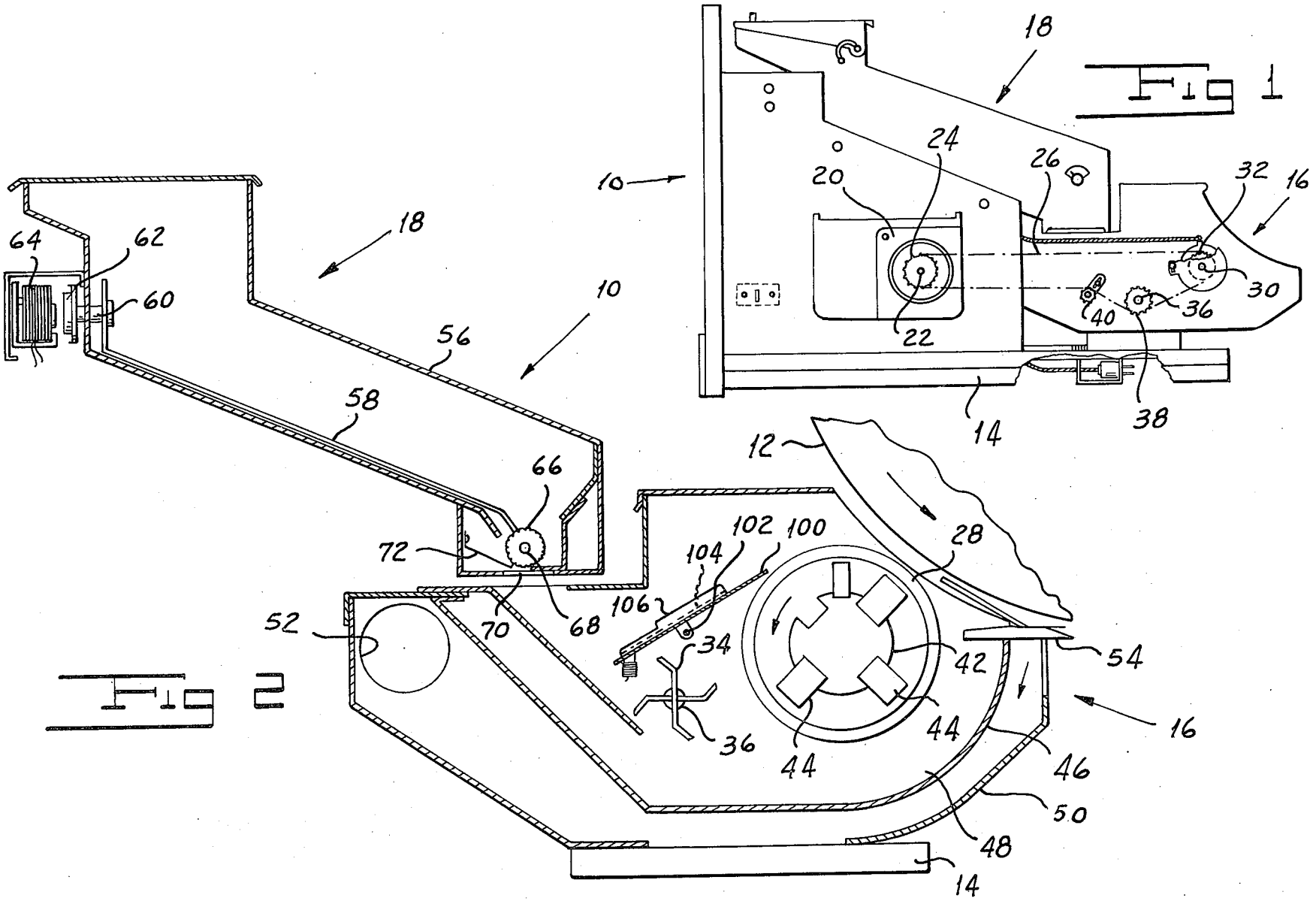
FIG. 1 is a side elevation of one type of electrostatic copying machine which may be provided with our toner concentration detector and toner replenishing system for a dry powder magnetic brush toning system, with the cover of the machine removed.
FIG. 2 is a fragmentary sectional view, drawn on an enlarged scale, of a portion of the machine shown in FIG. 1 illustrating the developer applicator and toner replenishing arrangement of the machine.

Referring now to FIGS. 1 and 2 of the drawings, one form of electrostatic copying machine, indicated generally by the reference character 10, with which our system may be employed includes a drum 12 having a photoconductor on the surface thereof and rotatably supported in a frame 14 for movement in the direction of the arrow shown in FIG. 2. The machine 10 includes a developer applicator system, indicated generally by the reference character 16, and a toner supply system, indicated generally by the reference character 18, from which toner is supplied to the developer applicator system 16 in a manner to be described hereinbelow.

Machine 10 includes a motor 20 having a shaft 22 carrying a sprocket 24 which drives a pitch chain 26 when the motor 20 is energized. The applicator unit 16 includes a cylinder 28 formed of non-magnetic material and rotatably supported in the frame 14. Cylinder 28 carries a shaft 30 which supports a sprocket wheel 32 adapted to be engaged by pitch chain 26 so as to be driven thereby in the direction of the arrow illustrated in FIG. 2. An agitator 34, making up part of the applicator unit 16, is supported by a shaft 36 carrying a sprocket wheel 38, which is also driven by the pitch chain 26. An idler sprocket 40 carried by an arm supported on the frame 14 is adapted to be positioned to adjust the tension in the chain 26.

A stationary support 42 disposed within the cylinder 28 carries a plurality of magnets 44 spaced around the periphery thereof. Cylinder 28 is mounted in a developer supply tray 46, carrying a supply of developer 48. As is known in the art, as the cylinder 28 rotates in the direction of the arrow, the fields produced by magnets 44 cause the carrier particles and toner particles adhering thereto to be carried along with the outer surface of the cylinder 28 so as to brush against the surface of the drum 12 carrying the latent electrostatic image. The field produced by the magnets 44 is such that, as the cylinder 28 rotates in a counterclockwise direction as viewed in FIG. 2, developer material is carried along with the cylinder from the lower portion of the tray 46 upwardly and into contact with the latent image on the surface of drum 12. After the cylinder passes top dead center, the magnetic field is substantially reduced so that the carrier particles tend to fall off the surface of the cylinder and back into the supply of developer in the tray 46. Preferably the machine 10 is provided with a scavenging air system which carries excess toner outwardly through a passsage formed by a wall 50 below the tray 46 and thence to an exhaust opening 52. Machine 10 also includes a doctor plate 54 located relatively closely adjacent to the surface of the drum 12 just past the area at which the magnetic brush develops the image.

Our monitoring arrangement, to be described hereinbelow, gives consistently good results with a wide variety of dry developers comprising a mixture of ferromagnetic particles and fusible toner particles. One standard developer with which we have tested our monitoring system is made up of carrier particles of ferromagnetic material ranging in size from about 1 micron to 300 microns and preferably in the range of from about 50 to about 175 microns and of toner particles ranging in size from about 0.2 micron to about 20 microns and preferably in the range of from about 5 to about 20 microns. For optimum image development the developer includes from about 96% to about 97% by weight of carrier particles. We have also used a toner with uncoated iron carrier particles and one with carrier particles which are coated with a thin layer of dielectric material which enhances the attraction of the charged toner particles to the carrier. These last two developers had carrier particles approximately 100 microns in size and toner particles of less than 10 microns. Further we tested samples of material incorporating 300 micron diameter iron spheres as the carrier. Our system gave consistently good results for all developers tested.

The toner supply system 18 of the machine 10 includes a housing 56 adapted to contain a supply of toner particles. A vibrator plate 58 resting on the bottom of the housing 56 is carried by a rod 60 extending outwardly through the wall of the housing 56. A permanent magnet 62 carried by the outboard end of rod 66 cooperates with a winding 64 which is so energized as to cause the plate 58 to vibrate to keep the toner particles in an agitated state in the housing 56. A serrated or knurled roller 66 is mounted on a shaft 68 so as to extend over the discharge opening 70 of the housing 56. A spring scraper arm 72 is mounted on the lower portion of the housing 56 so as to engage the surface of the roller 66. When the roller 66 is driven, toner particles are scraped off its surface and dropped into the developer tray 46 at a location at which they are mixed with the developer by the agitator 34.

Figures 3, 4, 5, 6:
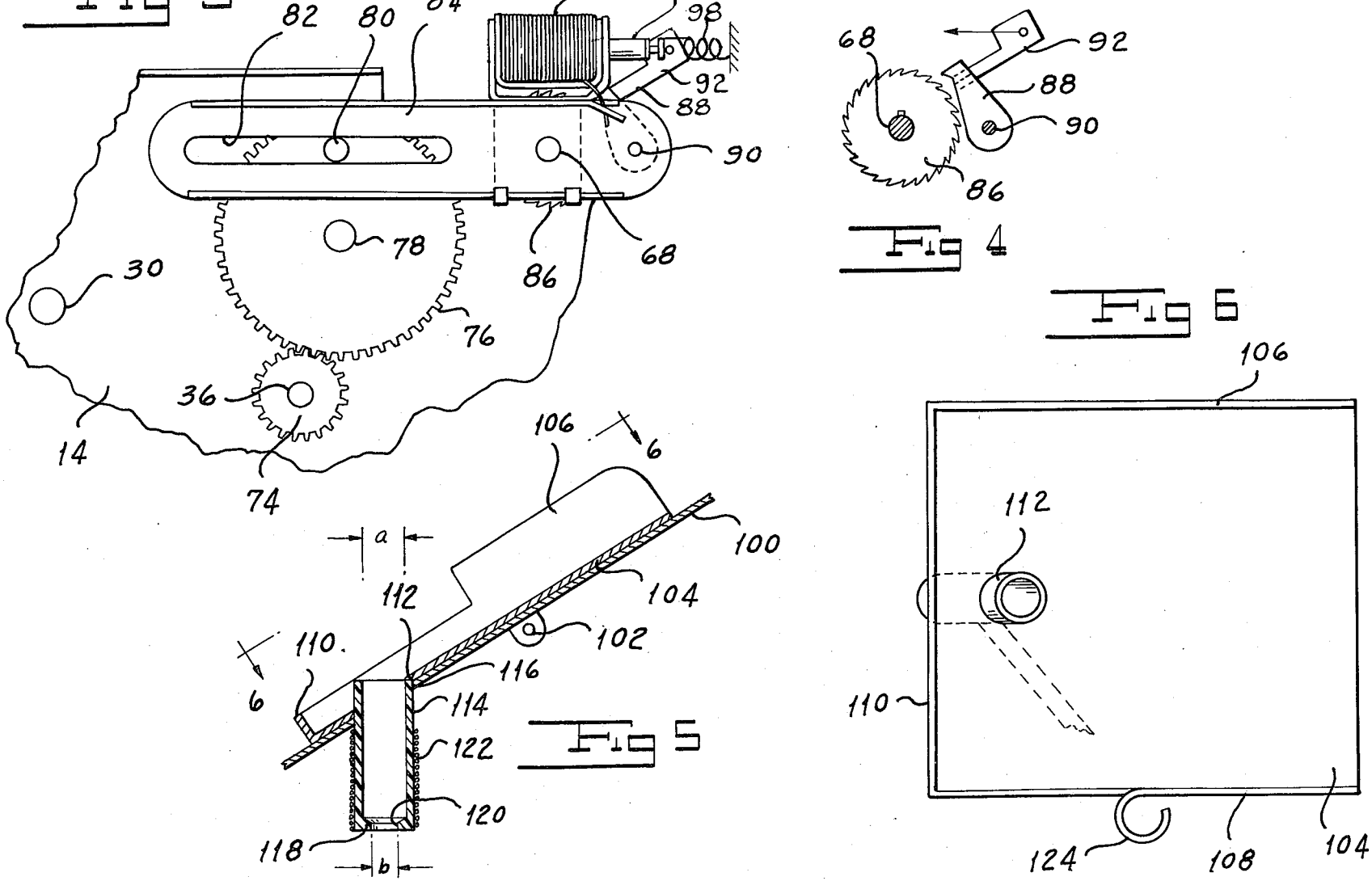
FIG. 3 is a fragmentary side elevation, drawn on an enlarged scale, of a portion of the toner replenishing system of the machine illustrated in FIG. 1.
FIG. 4 is a fragmentary sectional view illustrating the details of a portion of the mechanism illustrated in FIG. 3.
FIG. 5 is a fragmentary sectional view, drawn on an enlarged scale, of a portion of our concentration detector for dry powder magnetic brush toning systems.
FIG. 6 is a plan view of the apparatus illustrated in FIG. 5 taken along the line 6—6 of FIG. 5.

Referring now to FIGS. 3 and 4, the end of shaft 36 remote from the sprocket wheel 38 carries a gear 74 adapted to engage a gear 76 carried by a shaft 78 supported on the frame 14. Gear 76 carries a crankpin 80 which rides in a slot 82 in an arm 84 swingably supported on an end of the roller shaft 68. A ratchet wheel 86 is mounted on shaft 68 for rotation therewith at a location between the arm 84 and the sidewall of the frame 14. A pawl 88 pivotally supported on a pin 90 carried by the arm 84 is adapted to be moved to a position at which it can engage the teeth of ratchet wheel 86 so as to drive the wheel 86 and shaft 68 when the arm 84 oscillates in response to movement of the crankpin 80. A link 92 connects the pawl 88 to the armature 94 of a solenoid 96 having a return spring 98, which normally positions the arm 92 at a location at which the pawl 88 cannot engage the teeth of the ratchet wheel 86. However, when winding 96 is energized, armature 94 moves against the action of the spring 98 to move the pawl 88 to a location at which it can engage the teeth of ratchet wheel 86.

Referring now to FIGS. 2, 5 and 6, we mount a carrier separator plate or blade 100 in the tray 96 at a location at which the edge thereof is closely adjacent to the cylinder 28 at a location at which the magnetic field of magnets 44 is relatively weak so that particles coming off the cylinder tend to move downwardly across the upper surface of the plate 100 and downwardly into the tray 46 at which they are again mixed with the developer by the action of the agitator 34. Any suitable means, such, for example, as screws or the like 102, may be employed to secure the plate 100 in position.

Our toner concentration monitoring system includes a tray 104 secured to the upper surface of the plate 100 by any suitable means such, for example, as spot welding or the like. Tray 104 includes side walls 106 and 108 and a lower end wall 110. We so position the tray 104 that particles from the surface of cylinder 28 falling down the plate 100 move into the tray 104. Any suitable means, such, for example, as an epoxy resin 116 or the like, is employed to mount a tube 114 of generally cylindrical configuration and formed from a suitable dielectric, for example the synthetic resin "Delrin", which is the registered trademark of E. I. duPont de Nemours & Company for a thermoplastic acetyl resin. The walls 106, 108 and 110 may have gaps to aid in achieving the desired toner flow to the tube 114. We form the lower end of the generally cylindrical tube 114 with an inwardly directed annular flange 118 providing a restricted opening 120 at the outlet of the tube. As we have pointed out hereinabove, we have discovered that consistently satisfactory results cannot be achieved if unstable flow of developer through the tube 114 occurs. We so construct our tube as to inhibit such flow. Using a developer of the general type described above, we have discovered that satisfactory and consistent results can be produced using a tube having an inner diameter *a* of about 0.20 inch, if the diameter b of the outlet orifice 120 is reduced to about 0.135 inch. We have discovered further that an outlet orifice 120 having a diameter of about 0.160 inch or greater results in unstable flow under some conditions so that consistent results cannot be produced. Moreover, if the outlet orifice 120 is reduced to below about 0.120 inch, the tube clogs in high humidity so that the system does not operate satisfactorily. Moreover, in our arrangement the tube 114 is so mounted that in use its longitudinal axis is generally vertical. In one particular installation, the tube 114 has a length of about 0.625 inch. In addition, we mount the tray 104 generally centrally of plate 100 to ensure that our sensing system senses developer from that part of the magnetic brush which has passed over that part of the image corresponding to the part of the original which normally carries printing.

While we have shown and described a conduit or duct 114 which is cylindrical and a generally circular outlet opening 120, it is within the scope of our invention that a duct having other than a circular cross-sectional shape and an outlet opening which is other than circular be used. In such case the proper relationship between the cross-sectional area of the duct and the area of the outlet opening to avoid unstable flow are empirically determined.

We wind a coil 122 around that portion of the tube 112 in which the developer material is disposed in use of the device. For example, we may employ 52 turns of close-wound, single-layer, No. 34 American Wire Gauge copper magnet wire having a single film insulation. Wire of this type is sold by Phelps Dodge Company, for example, under the trade name "Nyleze". The coil normally extends from a point about 0.070 inch from the lower end of the tube 114 to a point about 0.180 inch from the upper end of the tube to provide a coil having a nominal length of 0.375 inch. With air in the tube 114 the coil has a nominal inductance of 9.5 microhenrys. Preferably, after mounting the tube in position, we protect the coil 122 with a coating of epoxy resin, for example.

Figure 7:
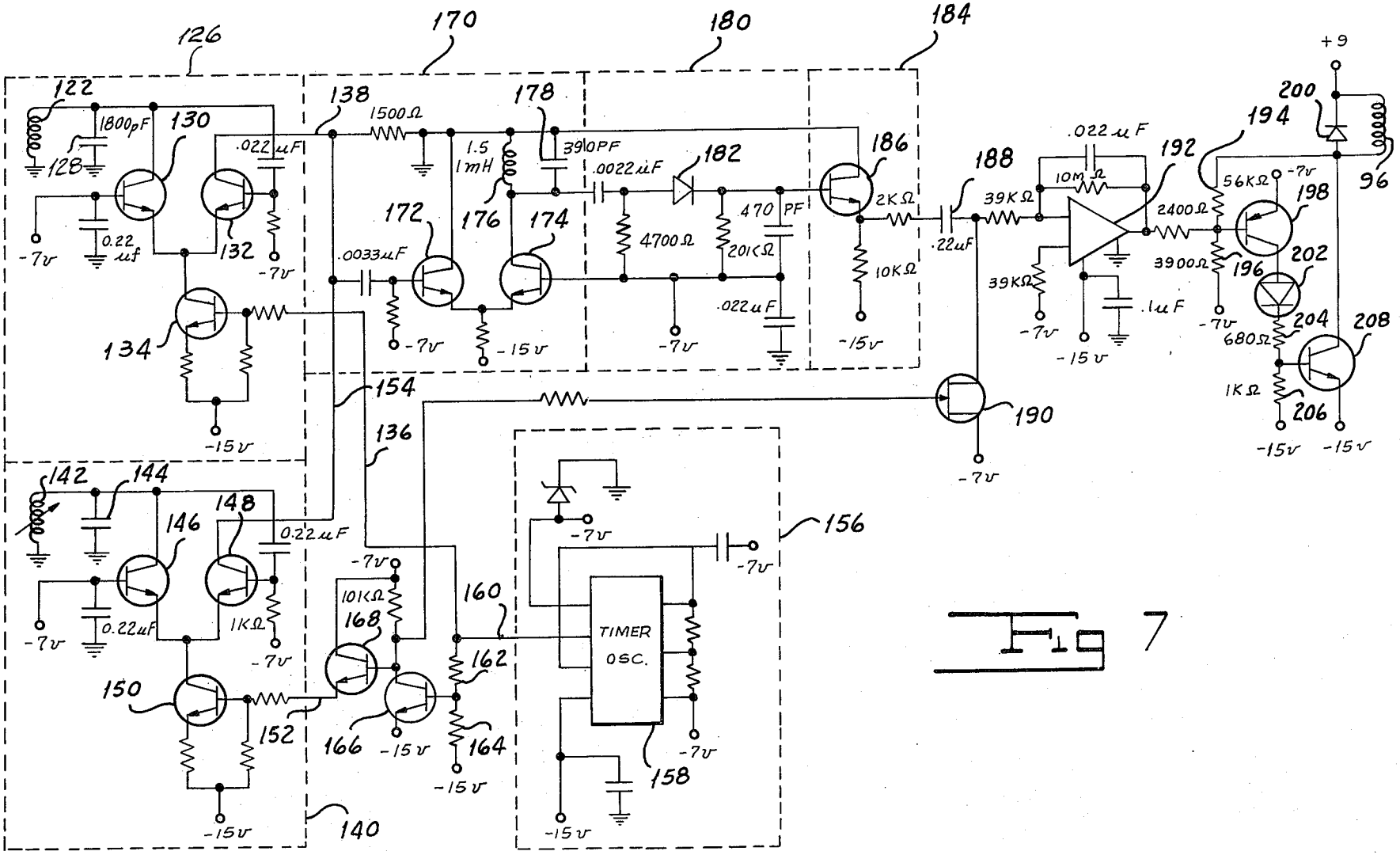
FIG. 7 is a schematic view of one form of electrical circuit which we may employ in our toner concentration detector and toner replenisher for dry powder magnetic brush toning systems.

Referring now to FIG. 7, we connect the coil 122 together with a capacitor 128 in the tuned circuit of a sensing oscillator 126 including transistors 130 and 132 and a control transistor 134 adapted to be rendered conductive in repsonse to an input on a line 136 to cause the oscillator to produce an output on line 138.

Our circuit includes a reference oscillator 140, the tuned circuit of which is made up of a variable inductor 142 and a capacitor 144 and which circuit includes a pair of transistors 146 and 148. A control transistor 150 is adapted to be rendered conductive upon the occurrence of a signal on line 152 to cause the sensing oscillator to provide an output on a line 154.

We provide our measuring circuit with a timing circuit 156 including a timer oscillator 158 operating at a frequency of about 300 hertz. The oscillators 126 and 140 operate at a frequency near 800 kilohertz.

In operation of the oscillator 158 the output line thereof alternatively is at a potential of about −15 volts and −7 volts. We connect line 160 to the line 136 providing the input for oscillator 126 and to the upper terminal of series connected resistors 162 and 164 leading to a terminal connected to a source of approximately −15 volts. The common terminal of the resistors 162 and 164 is connected to the base of a transistor 166, the collector of which is connected to a transistor 168, the emitter of which is connected to the input line 152 of oscillator 140.

From the structure just described and with the details of the circuit illustrated in FIG. 7, it will readily be appreciated that with line 160 at a potential of −15 volts, neither of the two transistors 134 or 166 will be conductive. However, under these conditions transistors 168 and 150 conduct so that the reference oscillator 140 is on. Alternatively, with line 160 at a potential of −7 volts, transistor 134 conducts so that the sensing oscillator 126 produces an output on line 138. At the same time transistors 168 and 150 are off, so that the reference oscillator 140 produces no signal on the output line 154.

We apply the outputs on lines 138 and 154 to the input of a limiter 170 made up of transistors 172 and 174 so that the outputs of the two oscillators are added. Limiter 170 feeds a square wave of current into a load made up of an inductor 176 having an inductance of approximately 1.5 millihenry, and a capacitor 178 having a capacitance of about 390 picofarads to produce a triangular wave. This triangular wave has a peak-to-peak value that decreases as oscillator frequency increases. Thus, if the sensing oscillator 126 is at a different frequency from that of the reference oscillator 140, the peak voltage output across the capacitive load will be slightly different during the interval that one oscillator is on, compared to that when the other oscillator is on. We feed this triangular waveform to a detector circuit 180 in which it is envelope detected by a rectifier 182 and is buffered by a transistor 186 in a circuit 184. A capacitor 188 having a capacitance of about 0.22 microfarads is connected to the output of circuit 184 to eliminate the DC component from the detector output. We connect the drain of a field effect transistor 190 to the output terminal of capacitor 188. The gate of transistor 190 is connected to the collector of transistor 166 to synchronously clamp the output from capacitor 188.

The AC component of the envelope detector appearing at the drain of transistor 190 is due to the difference of the triangular wave amplitudes discussed hereinabove. Thus, the peak-to-peak value of this voltage is directly related to the difference between the frequencies of the two oscillators.

This oscillator frequency difference voltage is synchronously clamped by the transistor 190 to produce a DC voltage which is amplified by an amplifier 192. We apply the amplified DC voltage to the common terminal of a pair of resistors 194 and 196 connected in series with a diode 200 between a terminal at a potential of approximately −7 volts and a terminal at a potential of +9 volts. The common terminal of the two resistors 194 and 196 provides the input to the base of a transistor 198, the collector of which is coupled to a terminal at a potential of approximately −15 volts by a light-emitting diode 202 connected in series with resistors 204 and 206. The common terminal of the two resistors 204 and 206 provides an input to a transistor 208 connected between diode 200 and a terminal at a potential of about −15 volts. We connect the solenoid winding 96 across the diode 200. The two transistors 198 and 208, together with their associated resistors, form a combination decision circuit and solenoid driver. When the frequency of oscillation of oscillator 126 becomes sufficiently low, transistor 198 begins to conduct to cause the light-emitting diode 202 to glow and to cause the solenoid 96 to be energized. When sufficient toner has been added, the frequency of the oscillator 126 increases to a point at which transistor 198 is cut off and no further toner is added.

In operation of our system for detecting toner concentration and for replenishing toner in the developer as required, the system is first calibrated by any suitable means known to the art to insure that the relay winding 96 pulls in at such an inductance value of the sensing coil as that which corresponds to a predetermined low concentration of toner in the developer. The calibration can be achieved by adjusting the inductor 142 in the oscillator circuit 140. Once the system has been set up, in the course of a development operation developer particles from the cylinder 28 fall downwardly along the plate 100 and into the trough 104. From the tray 104 a portion of the particles passes into the tube 114. As has been pointed out hereinabove, we so construct the tube 114 and so select the width of the outlet orifice 120 with relation to the inner diameter of the tube 114 as to inhibit turbulent flow of developer through the tube. The percentage of toner in the developer within the tube determines the inductance of the coil 122. As the proportion of toner to carrier particles decreases, the inductance of the coil increases. As the inductance of the coil increases, the frequency of oscillation of the oscillator 126 drops. As has been pointed out hereinabove, the frequency of oscillation of the oscillator 126 is compared with that of the reference oscillator 140. When the frequencies differ, there appears a DC signal at the input to amplifier 192. When the proportion of toner to developer carrier particles in the tube 114 drops below a predetermined desired percentage determined by the calibration of the system, the output of the amplifier 192 is sufficient to cause transistors 198 and 208 to fire to energize solenoid winding 96. With the winding 96 energized, link 92 moves pawl 88 to a position at which it can engage the teeth of the ratchet wheel 86. Thus, as the arm 84 oscillates in response to rotary movement of the gear 76, pawl 98 rotates shaft 68 to drive the roller 66 to cause toner particles from the supply in housing 56 to be added to the developer mix. When sufficient toner has been added to the developer mix, the frequency of oscillation of the oscillator 126 rises and the signal input to amplifier 192 decreases. When that occurs, solenoid winding 96 is deenergized until such time as the toner is again depleted to a predetermined concentration which again sets the system in operation.

It will be seen that we have accomplished the objects of our invention. We have provided a toner concentration detector and toner replenishing system which is especially adapted for use with dry developer systems employing a magnetic brush. Our system accurately measures relatively small changes in toner concentration. It is certain in operation. Our system is so arranged that consistently satisfactory results are produced.

It will be understood that cerain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. In an electrostatic copier having a member carrying a photoconductor adapted to receive a latent electrostatic image and a developer applicator for applying a developer made up of a mixture of toner particles and ferromagnetic carrier particles to said photoconductor to develop said image, a system for replenishing the toner in said developer including in combination, a supply of developer adapted to be applied to said photoconductor by said applicator, an elongated generally tubular conduit having an inlet and an outlet, means for carrying developer from said applicator to said inlet to cause developer to flow through said conduit from said inlet to said outlet, said conduit having a certain cross-sectional area immediately ahead of said outlet, means forming a restricted opening of a cross-sectional area substantially less than said certain area adjacent to said outlet for inhibiting unstable flow of said developer through said conduit, a winding carried by said conduit, means for measuring changes in the inductance of said winding, a supply of toner, and means responsive to said measuring means for feeding toner from said toner supply to said developer supply.

2. A system as in claim 1 in which said conduit is formed of dielectric material and in which said unstable flow inhibiting means comprises means forming a reduced opening at the outlet of said conduit.

3. A system as in claim 2 in which said conduit is a tube having an inner diameter of about 0.20 inch and in which said reduced opening has a diameter of between less than about 0.16 inch and greater than about 0.12 inch.

4. A system as in claim 3 in which said reduced opening has a diameter of about 0.135 inch.

5. A system as in claim 1 in which said applicator comprises a magnetic brush cylinder and in which said developer carrying means comprises a separator plate and means mounting said plate with an edge thereof closely adjacent to the surface of said cylinder to receive developer therefrom and means mounting said conduit in a position to receive developer from said plate.

6. Apparatus as in claim 5 in which the upper surface of said plate slopes downwardly from said edge and in which said conduit is mounted on said plate in a generally vertical position with the inlet thereof open to the upper surface of said plate.

7. Apparatus as in claim 1 in which said means responsive to said measuring means comprises an element adapted to be driven to deliver toner from said toner supply to said developer supply, drive means for driving said element, normally disengaged clutch means between said drive means and said element and means responsive to said measuring means for engaging said clutch means.

8. Apparatus as in claim 7 in which said clutch means comprises a ratchet wheel, a pawl associated with said wheel and means normally biasing said pawl out of engagement with said ratchet wheel and in which said means for engaging said clutch means comprises a solenoid adapted to be energized to move said pawl into engagement with said ratchet wheel against the action of said biasing means.

9. Apparatus as in claim 1 in which said measuring means includes an oscillator having a tuned circuit, means connecting said winding in the tuned circuit of said oscillator, and means for detecting changes in the frequency of said oscillator.

10. Apparatus as in claim 1 in which said measuring means includes a sensing oscillator having a tuned circuit, means connecting said winding in the tuned circuit of said sensing oscillator, a reference oscillator and means for detecting the difference in the frequencies of oscillation of said oscillators.

11. In an electrostatic copying machine having a member carrying a photoconductor adapted to receive a latent image, apparatus including means for holding a supply of developer made up of a mixture of toner particles and ferromagnetic carrier particles, magnetic brush means comprising a cylinder mounted adjacent to the surface of said member and adapted to be driven to carry developer from said supply into contact with the surface of said member, a separator plate, means mounting said plate with an edge thereof closely adjacent to the surface of said cylinder to remove developer therefrom and with the upper surface of said plate inclined downwardly from said edge to cause developer to move along said surface under the influence of gravity, an elongated generally tubular conduit of dielectric material having an inlet and an outlet, said conduit having a certain cross-sectional area immediately ahead of said outlet, means mounting said conduit on said plate in a generally vertical position with the inlet at a location to receive developer from the upper surface of said plate, means forming a reduced opening of a cross-sectional area substantially less than said certain area adjacent to the outlet of said conduit to inhibit unstable flow of developer through said tube, a winding carried by said tube between said inlet and said outlet, means for producing a signal in response to a change in the inductance of said winding, a supply of toner, an element adapted to be actuated to deliver toner from said toner supply to said developer supply, and means responsive to said signal for actuating said element.

12. Apparatus as in claim 11 in which said conduit is a tube having an inner diameter of about 0.20 inch and in which said reduced opening has a diameter of between less than about 0.160 inch and greater than about 0.12 inch.

13. Apparatus as in claim 12 in which said reduced opening has a diameter of about 0.135 inch.

14. Apparatus as in claim 11 in which said signal producing means comprises an oscillator having a tuned circuit, means connecting said winding in said tuned circuit, and means for detecting changes in the frequency of said tuned circuit.

15. Apparatus as in claim 11 in which said signal producing means comprises a sensing oscillator having a tuned circuit, means connecting said winding in the tuned circuit of said sensing oscillator, a reference oscillator, and means for detecting the difference in the frequencies of oscillation of said sensing and reference oscillators.

16. Apparatus as in claim 11 in which said conduit is a tube having an inner diameter of about 0.20 inch and in which said reduced opening has a diameter between less than about 0.16 inch and greater than about 0.12 inch and in which said signal producing means comprises a sensing oscillator having a tuned circuit, means connecting said winding in said tuned circuit, a reference oscillator and means for detecting the difference in the frequencies of oscillation of said oscillators.

17. Apparatus as in claim 11 in which said conduit mounting means comprises a tray having side walls and a lower end wall.

* * * * *